US007372407B2

(12) United States Patent
Shi

(10) Patent No.: US 7,372,407 B2
(45) Date of Patent: May 13, 2008

(54) COUPLED LOOP ARRAY ANTENNA

(75) Inventor: Shawn Shi, Thousand Oaks, CA (US)

(73) Assignee: Delphi Technologies, Inc., Troy, MI (US)

( * ) Notice: Subject to any disclaimer, the term of this patent is extended or adjusted under 35 U.S.C. 154(b) by 141 days.

(21) Appl. No.: 11/014,444

(22) Filed: Dec. 16, 2004

(65) Prior Publication Data

US 2006/0132368 A1 Jun. 22, 2006

(51) Int. Cl.
*H01Q 1/38* (2006.01)
*H01Q 21/00* (2006.01)

(52) U.S. Cl. ..... 343/700 MS

(58) Field of Classification Search ..... 343/700 MS
See application file for complete search history.

(56) References Cited

U.S. PATENT DOCUMENTS 4,054,874 A * 10/1977 Oltman, Jr. ..... 343/700 MS
4,335,385 A * 6/1982 Hall ..... 343/700 MS
4,398,199 A 8/1983 Makimoto et al.
4,554,549 A * 11/1985 Fassett et al. ..... 343/700 MS
4,633,262 A * 12/1986 Traut ..... 343/700 MS

OTHER PUBLICATIONS

Yang, et al: "Line-fed antenna coupler arrays", Antennas and Propagation Society International symposium, 1998, New York, NY, USA, IEEE, US, vol. 2, Jun. 21, 1998, pp. 1202-1205, XP010292354.

European Search Report dated Feb. 27, 2006.

* cited by examiner

*Primary Examiner*—Michael C. Wimer
(74) *Attorney, Agent, or Firm*—Jimmy L. Funke

(57) ABSTRACT

An antenna uses an at least substantially straight microstrip line as the feed for a linear array. A row of microstrip loops is located on a side of the feed line and at least substantially parallel to the feed line. Multiple iterations of this arrangement may be used to form a planar array antenna.

20 Claims, 1 Drawing Sheet

COUPLED LOOP ARRAY ANTENNA

TECHNICAL FIELD

This disclosure relates generally to antennas. More particularly, the disclosure relates to antennas for use in transmitting and receiving circularly polarized signals.

BACKGROUND OF THE DISCLOSURE

The vast majority of vehicles currently in use incorporate vehicle communication systems for receiving or transmitting signals. For example, vehicle audio systems provide information and entertainment to many motorists daily. These audio systems typically include an AM/FM radio receiver that receives radio frequency (RF) signals. These RF signals are then processed and rendered as audio output.

Vehicle video entertainment systems are gaining in popularity among motorists who want to provide expanded entertainment options to rear seat passengers, such as children. Rear seat passengers in vehicles equipped with video entertainment systems can watch movies or play video games to pass time during lengthy trips.

Some vehicle video entertainment systems incorporate tuners capable of receiving broadcast signals in the VHF and UHF frequency bands. Such systems allow passengers to watch broadcast television, further expanding their entertainment options. However, programming is limited to local broadcast stations. In addition, picture and sound quality is limited by the analog nature of the broadcast signals. Further, signal quality may be poor in some areas, such as remote locations.

Satellite-based broadcast systems, such as Direct Broadcast Satellite (DBS), provide subscribers with digital television programming. Because the signals used by DBS systems are digital, picture and sound quality is enhanced relative to traditional analog broadcasting systems. In addition, a DBS transmitter can provide coverage for a much larger geographic area than the terrestrial-based transmitters used by analog broadcasters. For example, it is possible to travel across a large portion of the United States without needing to change channels as different metropolitan areas are entered and exited.

Some conventional DBS receivers use a circularly polarized microstrip linear or planar array antenna to receive satellite signals. Circular polarization has long been used for communications, among other applications. Circular polarization is particularly well-suited for applications involving mobile receivers because the orientation of a circularly polarized signal does not change relative to the receiver as the receiver moves. Circularly polarized microstrip linear array antennas are preferably characterized by high efficiency, small beam walking, and good axial ratio at the satellite look angles.

Conventional microstrip linear array antennas include the rampart line linear array antenna and the loop line linear array antenna. Both of these types of microstrip linear array antennas suffer from large losses and extensive beam walking. Another conventional type of microstrip linear array antenna, known as the herringbone linear array antenna, does not provide a good axial ratio off its mechanical boresight.

SUMMARY OF VARIOUS EMBODIMENTS

According to various example embodiments, an antenna uses an at least substantially straight microstrip line as the feed for a linear array. A row of microstrip loops is located on a side of the feed line and at least substantially parallel to the feed line.

One embodiment is directed to an antenna formed by an at least substantially straight microstrip segment and a plurality microstrip loops located proximate a side of the at least substantially straight microstrip segment. The microstrip loops are arranged in a row at least substantially parallel to the at least substantially straight microstrip segment. The microstrip loops are spaced apart at least substantially equidistantly from one another.

In another embodiment, a planar array antenna is formed by at least substantially straight microstrip segments that are arranged at least substantially parallel to one another. Microstrip loops are arranged to form rows that are at least substantially parallel to one another. Each row is located proximate a corresponding at least substantially straight microstrip segment.

Yet another embodiment is directed to a communication system including a receiver and an antenna. The antenna is formed by an at least substantially straight microstrip segment and a plurality microstrip loops located proximate a side of the at least substantially straight microstrip segment. The microstrip loops are arranged in a row at least substantially parallel to the at least substantially straight microstrip segment. The microstrip loops are spaced apart at least substantially equidistantly from one another.

In still another embodiment, a communication system includes a receiver and a planar array antenna. The planar array antenna is formed by at least substantially straight microstrip segments that are arranged at least substantially parallel to one another. Microstrip loops are arranged to form rows that are at least substantially parallel to one another. Each row is located proximate a corresponding at least substantially straight microstrip segment.

Various embodiments may provide certain advantages. For instance, implementing the feed line as a substantially straight microstrip line reduces the length of the line relative to some conventional designs. This reduced line length may result in lower radio frequency (RF) loss and phase dispersion. As a result, various embodiments may provide higher efficiency and less beam walking relative to certain conventional antennas.

Additional objects, advantages, and features will become apparent from the following description and the claims that follow, considered in conjunction with the accompanying drawings.

DESCRIPTION OF VARIOUS EMBODIMENTS

An antenna uses an at least substantially straight microstrip line as the feed for a linear array. A row of microstrip loops is located on a side of the feed line and at least substantially parallel to the feed line.

In the following description, numerous specific details are set forth in order to provide a thorough understanding of various embodiments of the present invention. It will be apparent to one skilled in the art that various embodiments may be practiced without some or all of these specific details. In other instances, well known components have not been described in detail in order to avoid unnecessarily obscuring the invention.

Figure 1:
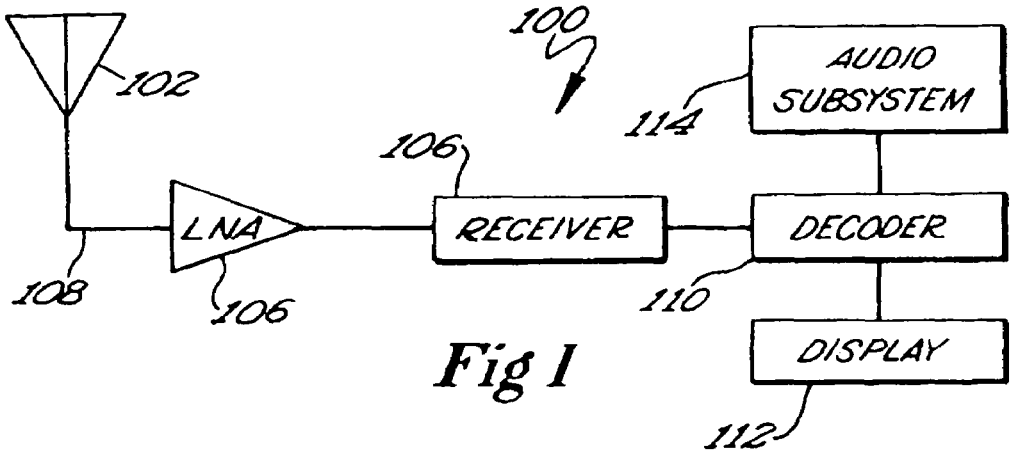
FIG. 1 is a block diagram illustrating an example communication system according to an embodiment.

Referring now to the drawings, FIG. 1 illustrates an example communication system 100, such as a vehicle entertainment system. In the communication system 100, a radio frequency (RF) signal is transmitted, for example, from a satellite transmitter to an antenna 102. In one embodiment, the RF signal is transmitted by a direct broadcast satellite (DBS) system. DBS systems use $K_u$-band satellites that transmit digitally-compressed television and audio signals to the Earth in what is called the Broadcast Satellite Service (BSS) portion of the $K_u$ band between 12.2 and 12.7 GHz. Due to digital compression technologies, DBS systems can deliver hundreds of cable TV-style programming channels, as well as local network television affiliates. DBS services generally offer better picture and sound quality and a greater selection of channels compared to analog cable and broadcast television. DBS services may also offer additional features, such as an on-screen guide, digital video recorder (DVR) functionality, high-definition television (HDTV), and pay-per-view (PPV) programming.

The RF signal is conducted to a low noise amplifier (LNA) 104 at an input of a receiver 106, for example, via an RF or coaxial cable 108. While not shown in FIG. 1, the RF signal may be conducted across a glass or other dielectric surface via a coupling device (not shown) that may employ capacitive coupling, slot coupling, or aperture coupling. The RF signal would then be provided to the LNA 104 via a matching circuit (not shown) connected to the coupling device. As an alternative, the RF or coaxial cable 108 may be connected to the antenna 102 through a hole drilled in the glass or other dielectric surface.

In the embodiment illustrated in FIG. 1, the antenna 102 is operatively coupled to the receiver 106. It will be appreciated by those skilled in the art that the antenna 102 can be operatively coupled to multiple communication devices. Some such communication devices may have both transmitting and receiving capabilities, and may be connected to antennas, such as transmitting antennas, other than the antenna 102. If the antenna 102 is located in a vehicle having multiple communication devices, the communication devices may be operatively coupled to the antenna via a high-speed data bus (not shown). The communication devices may include, e.g., one or more receivers in combination with one or more transmitters.

The receiver 106 is operatively coupled to a decoder 110, which decodes that RF signals received by the receiver 106. In addition, the decoder 110 may also perform an authentication function to verify that the communication system 100 is authorized to receive programming embodied in the RF signal. The decoded signal may contain audio and video components. The video component is rendered by a display 112, and the audio component is rendered by an audio subsystem 114, which may include a number of speakers.

Figure 2:
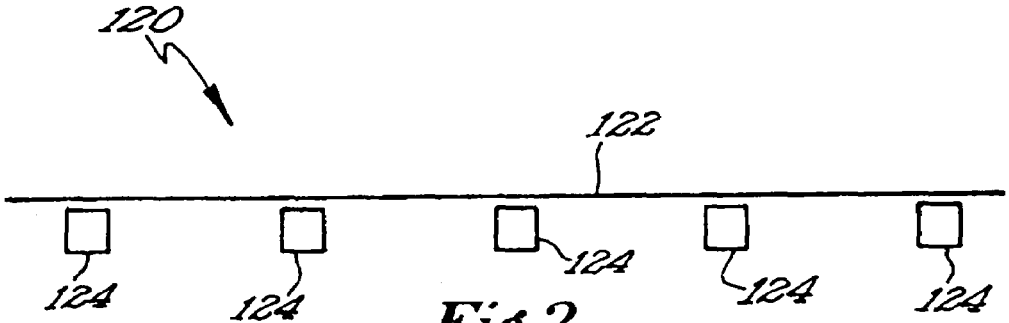
FIG. 2 is a diagram illustrating an example linear array antenna forming part of the communication system illustrated in FIG. 1.

FIG. 2 is a diagram illustrating an example linear array antenna 120 forming part of the communication system 100 illustrated in FIG. 1. The antenna 120 includes an at least substantially straight microstrip segment 122 that is used as a feed line for the antenna 120. The microstrip segment 122 may be formed, for example, from copper, silver, gold, or other suitable conductive materials, and has a length determined by the antenna gain and the beam width. Both orthogonal circular polarizations, i.e., right hand circular polarization (RHCP) and left hand circular polarization (LHCP) can be achieved by this configuration. Right hand circular polarization can be achieved by feeding one end of the microstrip segment 122. Left hand circular polarization can be achieved by feeding the other end of the microstrip segment 122.

Microstrip loops 124 are located proximate one side of the microstrip segment 122. The microstrip loops 124 may be generally-square shaped, as illustrated in FIG. 2, or may have some other rotationally symmetric shape. The microstrip loops 124 are arranged in a row that is at least substantially parallel to the microstrip segment 122 and are spaced at least substantially equidistantly from one another. For example, in the embodiment shown in FIG. 2, the microstrip loops 124 are spaced apart from one another by approximately one transmission line wavelength. The microstrip loops 124 are preferably sized approximately one transmission line wavelength in circumference. The transmission line wavelength depends on, for example, the thickness of the substrate and the dielectric constant for the particular microstrip material. In one particular example, the transmission line wavelength is approximately 1.55 cm.

In this arrangement of the microstrip segment 122 and the microstrip loops 124, when input power propagates from one end of the microstrip segment 122 to the other end, RF currents are coupled to the microstrip loops 124. These RF currents circulate in the microstrip loops 124. As the RF currents circulate, they radiate circularly polarized RF energy into free space.

With the asymmetric geometry of the antenna 120, that is, with the microstrip loops 124 located on one side of the microstrip segment 122, a good axial ratio can be achieved in the angular range at which the satellite transmitter appears to the antenna 120. In the United States, for example, the satellite transmitter appears to the antenna 120 at an angle of approximately 30° to 60° from the mechanical boresight. By comparison, a herringbone linear array antenna can typically only achieve a good axial ratio close to the mechanical boresight due to its geometric symmetry.

In addition, because the feed line, i.e., the microstrip segment 122, is a relatively uniform and straight microstrip line, the length of the microstrip segment 122 may be kept relatively low. As a result, RF loss and phase dispersion may be reduced. The antenna 120 may therefore exhibit higher efficiency and less beam walking than, for example, rampart line linear array antennas and loop line linear array antennas, both of which are characterized by longer feed lines.

Figure 3:
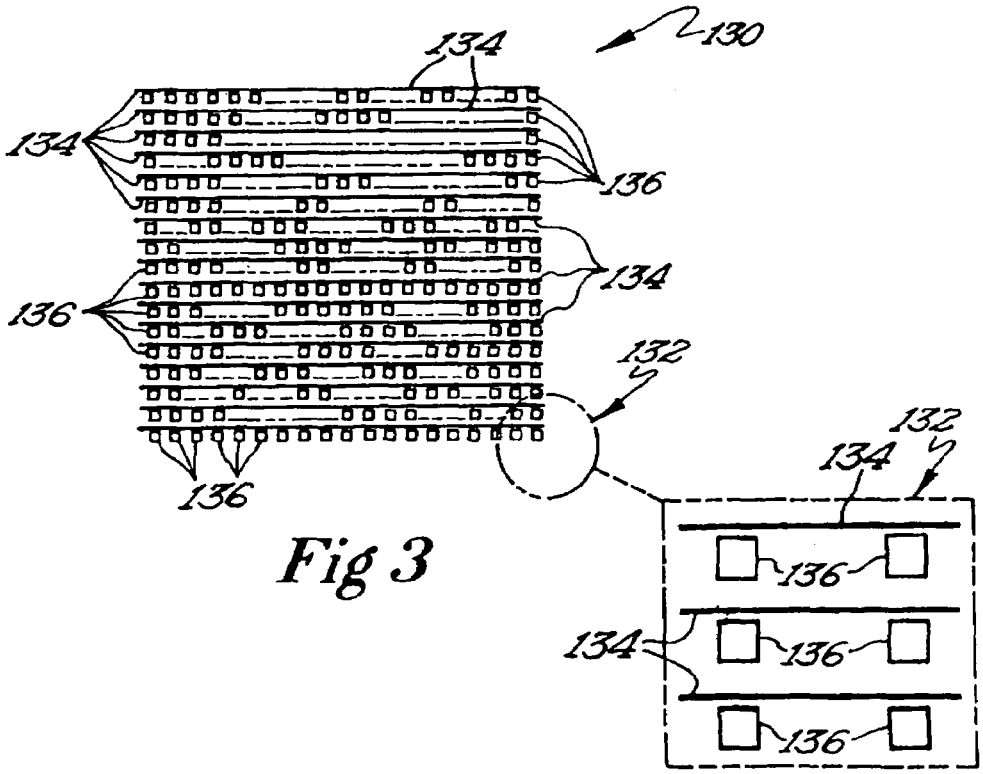
FIG. 3 is a diagram illustrating an example planar array antenna forming part of the communication system illustrated in FIG. 1.

FIG. 3 is a diagram illustrating an example planar array antenna 130 forming part of the communication system 100 illustrated in FIG. 1. FIG. 3 also illustrates an enlarged view of a portion 132 of the antenna 130. The antenna 130 may be mounted, for example, on the top of a vehicle for receiving DBS signals. The antenna 130 is formed by a number of at least substantially straight microstrip segments 134 that are arranged at least substantially parallel to one another. The microstrip segments 134 serve as feed lines for the antenna 130. Both orthogonal circular polarizations, i.e., right hand circular polarization (RHCP) and left hand circular polarization (LHCP) can be achieved by this configuration. Right hand circular polarization can be achieved by feeding one end of the microstrip segments 134. Left hand circular polarization can be achieved by feeding the other ends of the microstrip segments 134.

Microstrip loops 136 are arranged to form rows that are at least substantially parallel to one another. The microstrip loops 136 may be generally-square shaped, as illustrated in FIG. 3, or may have some other rotationally symmetric shape. The rows may be spaced apart, for example, 0.5-0.9 free-space wavelengths from one another. The free-space wavelength depends on the center frequency of the communication band. For example, for $K_u$ band DBS transmissions, the free-space wavelength is approximately 2.41 cm.

Each row of microstrip loops 136 is located proximate a corresponding microstrip segment 134. Within each row of microstrip loops 136, the microstrip loops 136 are spaced at least substantially equidistantly from one another. For example, in the embodiment shown in FIG. 3, the microstrip loops 136 are spaced apart from one another by approximately one transmission line wavelength. The microstrip loops 136 are preferably sized approximately one transmission line wavelength in circumference. The transmission line wavelength depends on, for example, the thickness of the substrate and the dielectric constant for the particular microstrip material. In one particular example, the transmission line wavelength is approximately 1.55 cm.

In this array of microstrip segments 134 and microstrip loops 136, when input power propagates from one end of the microstrip segments 134 to the other end, RF currents are coupled to the microstrip loops 136. These RF currents circulate in the microstrip loops 136. As the RF currents circulate, they radiate circularly polarized RF energy into free space.

With the asymmetric geometry of the antenna 130, that is, with the microstrip loops 136 in each row located on one side of the microstrip segment 134, a good axial ratio can be achieved in the angular range at which the satellite transmitter appears to the antenna 130. In the United States, for example, the satellite transmitter appears to the antenna 130 at an angle of approximately 30° to 60° from the mechanical boresight. In addition, because the microstrip segments 134 are relatively uniform and straight microstrip lines, the length of the feed line may be kept relatively low. As a result, RF loss and phase dispersion may be reduced. The antenna 130 may therefore exhibit higher efficiency and less beam walking than, for example, rampart line linear array antennas and loop line linear array antennas, both of which are characterized by longer feed lines.

As demonstrated by the foregoing discussion, various embodiments may provide certain advantages. For instance, implementing the feed line as a substantially straight microstrip line reduces the length of the line relative to some conventional designs. This reduced line length may result in lower radio frequency (RF) loss and phase dispersion. As a result, various embodiments may provide higher efficiency and less beam walking relative to certain conventional antennas. In addition, the coupled loop array antenna is light weight and has a low profile and can be manufactured relatively inexpensively.

It will be understood by those skilled in the art that various modifications and improvements may be made without departing from the spirit and scope of the disclosed embodiments. The scope of protection afforded is to be determined solely by the claims and by the breadth of interpretation allowed by law.

What is claimed is:

1. An antenna comprising:

an at least substantially straight microstrip segment; and a plurality of microstrip loops located proximate a side of the at least substantially straight microstrip segment, the microstrip loops arranged in a row at least substantially parallel to the at least substantially straight microstrip segment, the microstrip loops spaced apart at least substantially equidistantly from one another, wherein when an electrical current propagates through the at least substantially straight microstrip segment, radio frequency (RF) currents couple the at least substantially straight microstrip segment to the plurality of microstrip loops, such that the plurality of microstrip loops radiate circularly polarized RF energy.

2. The antenna of claim 1, wherein the microstrip loops are spaced apart from one another by a distance at least substantially equal to one transmission line wavelength.

3. The antenna of claim 1, wherein the microstrip loops each have a perimeter at least substantially equal to one transmission line wavelength.

4. The antenna of claim 1, wherein the at least substantially straight microstrip segment has first and second ends, wherein the antenna is placed in a first circular polarization mode by providing RF energy to the first end, and wherein the antenna is placed in a second circular polarization mode by providing RF energy to the second end.

5. A planar array antenna comprising:

a plurality of at least substantially straight microstrip segments arranged at least substantially parallel to one another on a substrate; and a plurality of microstrip loops arranged to form a plurality of rows that are at least substantially parallel to one another, each row located on the substrate and proximate a corresponding at least substantially straight microstrip segment, wherein when an electrical current propagates through the at least substantially straight microstrip segment, radio frequency (RF) currents couple the plurality of at least substantially straight microstrip segments with the corresponding plurality of microstrip loops, such that the plurality of microstrip loops radiate circularly polarized energy.

6. The planar array antenna of claim 5, wherein the microstrip loops forming each row are spaced apart at least substantially equidistantly from one another.

7. The planar array antenna of claim 5, wherein the microstrip loops forming each row are spaced apart from one another by a distance at least substantially equal to one transmission line wavelength.

8. The planar array antenna of claim 5, wherein the microstrip loops each have a perimeter at least substantially equal to one transmission line wavelength.

9. The planar array antenna of claim 5, wherein each at least substantially straight microstrip segment has first and second ends, wherein the antenna is placed in a first circular polarization mode by providing RF energy to the first ends, and wherein the antenna is placed in a second circular polarization mode by providing RF energy to the second ends.

10. A communication system comprising:

a receiver; and an antenna comprising an at least substantially straight microstrip segment on a substrate; and a plurality of microstrip loops located on the substrate and proximate a side of the at least substantially straight microstrip segment, the microstrip loops arranged in a row at least substantially parallel to the at least substantially straight microstrip segment, the microstrip loops spaced apart at least substantially equidistantly from one another, wherein the at least substantially straight microstrip segment has first and second ends, wherein the antenna is placed in a first circular polarization mode by providing radio frequency (RF) energy to the first end, and wherein the antenna is placed in a second circular polarization mode by providing RF energy to the second end, such that the RF energy couples the at least substantially straight microstrip segment and the plurality of microstrip loops and the plurality of microstrip loops radiate circularly polarized energy.

11. The communication system of claim 10, wherein the microstrip loops are spaced apart from one another by a distance at least substantially equal to one transmission line wavelength.

12. The communication system of claim 10, wherein the microstrip loops each have a perimeter at least substantially equal to one transmission line wavelength.

13. The communication system of claim 10, wherein the antenna is configured to receive RF energy from a direct broadcast satellite (DBS) system.

14. A communication system comprising:

a receiver; and a planar array antenna comprising a plurality of at least substantially straight microstrip segments arranged at least substantially parallel to one another on a substrate; and a plurality of microstrip loops arranged to form a plurality of rows that are at least substantially parallel to one another, each row located on the substrate and proximate a corresponding at least substantially straight microstrip segment, wherein when an electrical current propagates through the at least substantially straight microstrip segment, radio frequency (RF) currents couple the plurality of at least substantially straight microstrip segments with the corresponding plurality of microstrip loops, such that the plurality of microstrip loops radiate circularly polarized energy.

15. The communication system of claim 14, wherein the microstrip loops forming each row are spaced apart at least substantially equidistantly from one another.

16. The communication system of claim 14, wherein the microstrip loops forming each row are spaced apart from one another by a distance at least substantially equal to one transmission line wavelength.

17. The communication system of claim 14, wherein the microstrip loops each have a perimeter at least substantially equal to one transmission line wavelength.

18. The communication system of claim 14, wherein each at least substantially straight microstrip segment has first and second ends, wherein the antenna is placed in a first circular polarization mode by providing RF energy to the first ends, and wherein the antenna is placed in a second circular polarization mode by providing RF energy to the second ends.

19. The communication system of claim 14, wherein the planar array antenna is configured to receive radio frequency (RF) energy from a direct broadcast satellite (DBS) system.

20. A method of radiating circular polarization, the method comprising the steps of:

propagating an input power through a substantially straight microstrip segment;

coupling the substantially straight microstrip segment with a plurality of microstrip loops by radio frequency (RF) currents;

circulating RF currents through the plurality of microstrip loops; and radiating circularly polarized RF energy from the plurality of microstrip loops.

* * * * *